United States Patent [19]

Romer et al.

[11] Patent Number: 4,598,644

[45] Date of Patent: Jul. 8, 1986

[54] USE OF A PORTION OF A PROPELLANT CHARGE AS A SEAL

[75] Inventors: Rudolf Romer, Kaarst; Walter Simon, Herzogenrath; Jürgen Boecker, Oberhausen; Bernhard Bisping, Ratingen, all of Fed. Rep. of Germany

[73] Assignee: Rheinmetall GmbH, Duesseldorf, Fed. Rep. of Germany

[21] Appl. No.: 720,490

[22] Filed: Apr. 8, 1985

Related U.S. Application Data

[63] Continuation of Ser. No. 444,983, Nov. 29, 1982, abandoned.

[30] Foreign Application Priority Data

Dec. 5, 1981 [DE] Fed. Rep. of Germany ..... 3148264

[51] Int. Cl.[4] ..... F42B 13/16

[52] U.S. Cl. ..... 102/521; 102/532; 102/703

[58] Field of Search ..... 102/430–433, 102/501, 503, 520–523, 532, 703

[56] References Cited

U.S. PATENT DOCUMENTS

| | | | |
|---|---|---|---|
| 1,899,618 | 2/1933 | Holthe | 102/503 |
| 3,882,777 | 5/1975 | Rausing | 102/431 |
| 3,899,978 | 8/1975 | Luther et al. | 102/521 |
| 4,424,748 | 1/1984 | Schiff | 102/523 |
| 4,444,113 | 4/1984 | Campoli | 102/703 |
| 4,444,114 | 4/1984 | Bisping | 102/430 |

*Primary Examiner*—Harold J. Tudor

[57] ABSTRACT

A subcaliber projectile having a sabot formed by a plurality of segments is provided. The joined segments forming the sabot, present a gas pressure receiving surface 52 which is covered by a sealing foil 54 formed by a foil material made out of the propellant charge material to seal the joints formed on the gas pressure receiving surface. This foil material is firmly bonded to a portion 62 of the propellant charge proper.

3 Claims, 6 Drawing Figures

USE OF A PORTION OF A PROPELLANT CHARGE AS A SEAL

This application is a continuation of Ser. No. 444,983 filed Nov. 29, 1982, now abandoned.

BACKGROUND OF THE INVENTION

The invention relates to the use of a portion of a propellant charge as a sealing medium for a sabot of a subcaliber projectile.

In the coassigned U.S. Pat. No. 3,620,167 there is disclosed a subcaliber projectile with a sabot having a gas pressure receiving surface that is covered with a flat sealing element made of elastic material. This sealing element serves to prevent the escape of the propellant charge gases through gaps formed by the joints that are present between the segments forming the sabot. Such gaps formed by the joints between the segments forming the sabot may cause difficulties during the separation of the segments from the subcaliber projectile body. However, this known sealing element has been found in practice to constitute a disturbing component of the dead weight of the subcaliber projectile.

SUMMARY OF THE INVENTION

It is a general object of this invention to provide a seal for a sabot of a subcaliber projectile which insures an undisturbed separation of the sabot from the projectile body and by the use of which the dead weight of the subcaliber projectile can be significantly reduced.

BRIEF DESCRIPTION OF THE DRAWING

With this and other objects in view, which will become apparent in the following detailed description, the present invention, which is shown by example only, will be clearly understood in connection with the accompanying drawing, in which.

DETAILED DESCRIPTION

Figure 1:
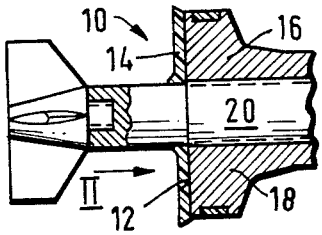
FIG. 1 illustrates in longitudinal, partially cross-sectional, axial section a sabot construction forming the state of the art.
Figure 2:
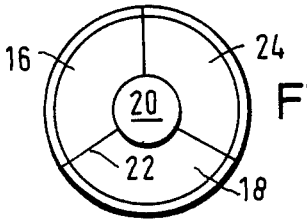
FIG. 2 illustrates a plan view in the direction of the arrow II of the sabot construction of FIG. 1.

The sabot construction of the state of the art, as illustrated in FIGS. 1 and 2, includes a sabot 10 of a subcaliber projectile 20 which has affixed to its gas pressure receiving surface 12 a flat sealing element 14 made of an elastic substance. The sabot construction 10 includes three segments 16, 18 and 24 which are respectively separated by joints 22. The segments 16, 18 and 24 jointly form an integral gas pressure receiving surface 12 having joints 22.

Figure 3:
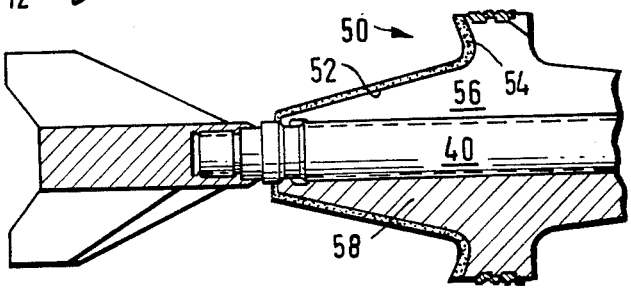
FIGS. 3 to 6 illustrate longitudinal sectional views, partially in cross-section, of four embodiments of sabot constructions in accordance with the invention.

In the embodiment in accordance with FIG. 3 the gas pressure receiving surface 52 of the sabot 50 is provided with a sealing membrane 54 which is formed by means of a foil of propellant charge material. The burning velocity of the foil is precisely predetermined (in case of need by desensitization of the propellant foil material in the region of the joints 22 between the segments 58 and 56) for the purpose of providing a reliable sealing during the traverse of the subcaliber projectile 40 through a propellant charge casing, gun barrel or the like, on the one hand, and to insure, on the other hand, that no disturbance of the separation process of the segments from the projectile body occurs after the projectile has left the muzzle of the gun barrel or a propellant charge casing.

Figure 4:
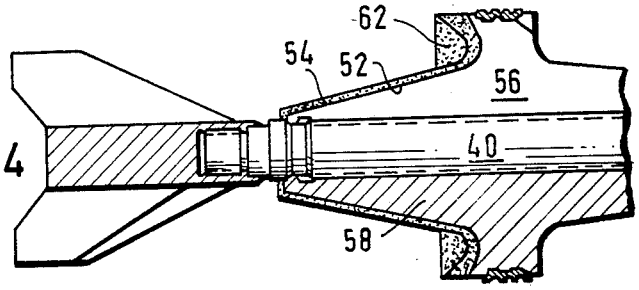
Figure 5:
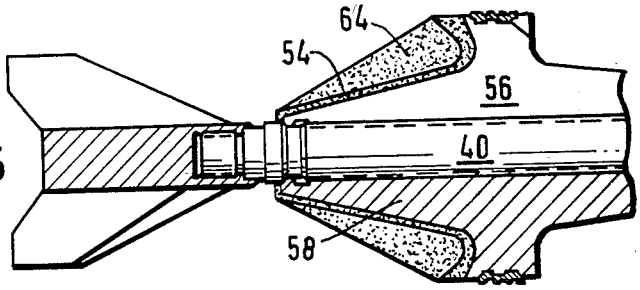
Figure 6:
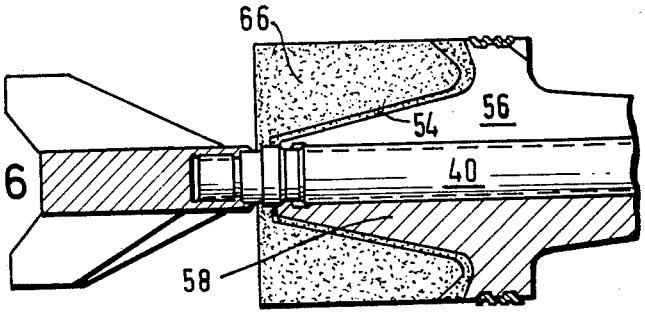

In the embodiments of FIGS. 4, 5 and 6 there is provided a corresponding part 62, 64, 66 of a propellant charge which is firmly joined to the membrane 54 in order to achieve in this way a co-acceleration of that portion of the propellant charge and the advantages which flow therefrom.

Although the invention is illustrated and described with reference to a plurality or preferred embodiments thereof, it is to be expressly understood that it is in no way limited to the disclosure of such a plurality of preferred embodiments, but capable of numerous modifications within the scope of the appended claims.

We claim:

1. In an improved subcaliber projectile, with a sabot around the middle of the projectile body, adapted to be fired from a gun barrel or the like by means of a propellant charge, the improvement comprising:

(a) said sabot formed by a plurality of separable adjoining segments whose exterior peripheries are held together by means of at least one annular guide or sealing band until the sabot leaves the muzzle of the gun barrel (b) said segments jointly present a propellant charge gas pressure receiving surface and an air pressure receiving surface axially forwardly spaced from said gas pressure receiving surface, each pair of adjoining segments define at least one joint therebetween which extends through said propellant charge gas pressure receiving surface;

(c) a sealing membrane in the form of a foil, which is made of propellant charge material, is at least partially disposed in that portion of each joint which extends through said propellant charge gas pressure receiving surface and covers substantially the entirety of each joint, (d) the front end face of said sabot forming an air pressure receiving pocket for receiving an air streaming upon emergence of the projectile from the muzzle of a gun barrel which causes a radially outwardly pivoting of said sabot segments about a pivoting point on said subcaliber projectile which is disposed rearwardly of said air pressure receiving pocket;

(e) the rear end face of said sabot forming at least a portion of said propellant charge pressure receiving surface for receiving the propellant gas pressure of a propellant charge;

(f) said propellant charge pressure receiving surface extends from the rear side of said annular guide or sealing band rearwardly to a circular edge formed at the rearmost and radially innermost edge of the plurality of segments, said circular edge forming part of the rear end region of each segment which is last to lose contact with the subcaliber projectile upon emergence from the gun barrel, rupture of said guide, and radially outward pivoting of the plurality of sabot segments;

(g) said sealing membrance prevents a penetration of propellant charge gases between the joint defined by the adjoining sabot segments and through a boundary contact zone between the sabot and the gun barrel, said sealing membrance consisting of a desensitized propellant charge powder which combusts in such a way that a uniform and undisturbed separation of the plurality of sabot segments is effected after their emergence from the gun barrel;

(h) said gas pressure receiving surface being inclined relative to the longitudinal axis of the subcaliber projectile; and (i) said foil consists of a propellant charge material whose burning velocity is such that a sealing of the joints between the segments occur only when the projectile passes through the gun barrel.

2. The improvement in a subcaliber projectile as set forth in claim 1, wherein a predetermined portion of said propellant charge is firmly bonded to said foil.

3. The improvement in a subcaliber projectile as set forth in claim 2, wherein said plurality of segments are form-lockingly mounted on said subcaliber projectile in a region thereof in which said propellant gas pressure receiving surface axially overlaps, which region is axially rearwardly spaced from said air pressure receiving surface, so that said segments separate from the projectile upon exiting from the gun barrel by pivoting outwardly about said region.

* * * * *